United States Patent [19]

Langen

[11] 4,028,866

[45] June 14, 1977

[54] WRAP-AROUND CARTON FORMING MACHINE

[75] Inventor: Marinus J. M. Langen, Rexdale, Canada

[73] Assignee: H. J. Langen & Sons Ltd., Rexdale, Canada

[22] Filed: Sept. 29, 1975

[21] Appl. No.: 617,310

Related U.S. Application Data

[62] Division of Ser. No. 553,269, Feb. 26, 1975, Pat. No. 3,968,623.

[52] U.S. Cl. ..... 53/195; 53/252

[51] Int. Cl.[2] ..... B65B 11/22

[58] Field of Search ..... 53/195, 207, 232, 233, 53/234, 252; 93/12 C, 44

[56] References Cited

UNITED STATES PATENTS

| | | | |
|---|---|---|---|
| 1,110,125 | 9/1914 | Giroud | 53/207 X |
| 1,647,745 | 11/1927 | Parker | 53/252 X |
| 2,196,666 | 4/1940 | Moore | 53/234 X |
| 2,603,925 | 7/1952 | Moore | 53/234 X |
| 3,014,321 | 12/1961 | Lesch | 53/195 |
| 3,333,396 | 8/1967 | Paal et al. | 53/252 |
| 3,545,172 | 12/1970 | Osterdahl | 53/252 X |
| 3,589,097 | 6/1971 | Gianese | 93/44 X |
| 3,805,477 | 4/1974 | Kruse et al. | 53/234 X |

*Primary Examiner*—Othell M. Simpson
*Assistant Examiner*—John Sipos
*Attorney, Agent, or Firm*—Fetherstonhaugh & Co.

[57] ABSTRACT

A carton loading and forming machine having a carton dispenser magazine which includes a walking beam mechanism arranged to underlie portions of the carton blanks in the magazine for moving the carton blanks towards the discharge end of the magazine. The magazine is adapted to suspend the blanks from support rails disposed at opposite sides of the blanks and arranged above the center of gravity of the blanks so that the blanks hang freely from the support rails. The machine also includes transfer means for transferring carton blanks from the dispenser to a wrapping station. The transfer means including a laterally extending carton blank conveyor for moving carton blanks laterally from the dispenser mechanism to the carton wrapping station. Plow blades are provided adjacent the conveyor to fold the carton blanks, as they travel along the conveyor, to a generally U-shaped configuration opening in a direction to receive a mandrel travelling along the wrapping path. The apparatus also provides a plurality of carton forming mandrels and a mandrel exchange station in which the mandrels may be speedily removed and replaced by mandrels of different size.

1 Claim, 22 Drawing Figures

146
144
142
154
156
168
160
140
162
7
120
132
134
129
150
152
128
126
124
122
130
158

WRAP-AROUND CARTON FORMING MACHINE

This is a division of application Ser. No. 553,269, filed Feb. 26, 1975, now U.S. Pat. No. 3,968,623.

This invention relates to improvements in wrap-around carton loading and forming machines.

RELATED APPLICATIONS

This invention is closely related to my copending U.S. application, Ser. No. 376,556, filed July 5, 1973 now U.S. Pat. No. 3,875,724 and entitled "Method of Forming Wrap-Around Shipper Package" and my copending U.S. application, Ser. No. 434,043, filed Jan. 17, 1974, now U.S. Pat. No. 3,879,920 entitled "Machine for Forming Wrap-Around Shipper Packages".

PRIOR ART

Blank Dispensers Magazine

Various dispensers have been designed for use in the dispensing of carton blanks. These dispensers employ a support structure which serves to support the blanks in a face-to-face stacked relationship. Generally the blanks are supported from their lower edge and at their side and upper edges in a dispenser magazine and the blanks are removed one at a time through an end of the magazine. The blanks are removed from the package in which they are shipped from the carton fabricator and loaded directly into the magazine in bulk. The carton blanks as received from the carton fabricator frequently contain cuttings and scrap material located between the adjacent blanks. These cuttings can create difficulties in the dispensing of the cartons one at a time from the dispenser. This difficulty is overcome in the dispenser magazine for the present invention by reason of the fact that the carton blanks are suspended from above their center line so that clippings located between the blanks are free to fall out of the stack. Furthermore, as will be described hereinafter, the agitation of the carton blanks by the feeding mechanism of the dispenser serves to release any clippings which are located between the blanks.

Difficulty has long been experienced in advancing carton blanks towards the dispenser opening of a dispenser magazine in a manner which will ensure that a blank is always in position for removal from the dispenser. In most dispenser mechanism, an endless chain drive is used to engage the lower edges of the cartons and to advance the cartons towards the dispenser end of the dispenser magazine in response to the activation of a pressure-sensitive switch at the dispenser opening. If the pressure-sensitive switch at the dispenser opening detects a condition under which a reduced pressure is applied to the switch, the drive mechanism is activated to advance the chain so as to move the blanks towards the dispenser opening until the pressure at the pressure-sensitive switch is sufficient to activate the switch to interrupt the drive. This mechanism is not completely satisfactory as there are conditions, such as conditions in which the leading carton blank is jammed at the dispenser opening, which might indicate a lack of adequate pressure at the discharge opening which would in turn activate the drive mechansim. This condition can cause severe overloading of the drive mechanism and damage to the blanks within the magazine. Systems of this type require the constant surveillance of a machine operator. The carton blank dispenser magazine of the present invention overcomes the difficulties described above by providing a walking beam mechanism which incorporates a releasable clutch which permits continuous cyclic operation of the walking beam mechanism. The extend to which the walking beam attempts to advance the cartons in any one cycle is relatively small so that it will not damage the carton blanks even under circumstances where it is not necessary to advance the blanks. The releasable clutch serves to ensure that the walking beam mechanism is not advanced towards the dispenser opening when advancement is not required.

A further difficulty which is experienced in the carton blank dispenser magazines presently in use is that the last carton in the stack of cartons is difficult to support in an upright position unless a large end plate is used or unless the cartons are inclined with respect to the vertical plane in a direction towards the dispenser opening. This difficulty is overcome in the dispenser magazine of the present invention by reason of the fact that the carton blanks are supported by support beams located in notches formed at the edges of the blanks at a level above the center of gravity of the blanks. By supporting the blanks in this manner, the blanks will be suspended in a vertical plane and will remain in the vertical plane without the aid of any additional supports. It follows that the last blank in the dispenser will also be self-supporting.

A further advantage which is derived from the supporting of the carton blanks above their center of gravity is in the fact that the cartons will always hang straight at the point of pick-off at the dispenser opening and this facilitates the dispensing of the cartons from the magazine.

Fixed Datum Line

In prior carton loading machines, difficulty has always been experienced in minimizing the down time involved in adjusting the machine to accommodate various carton blank sizes. This difficulty is encountered in view of the fact that both ends of the carton have to be closed during the passage of the carton through the machine and the ends which are to be closed must be located in a plane for closing. The ends of cartons of different sizes are, of course, spaced from one another by different amounts and adjustment must be made to take this into consideration when adjusting the machine for different sized cartons. This difficulty is overcome in the present invention by providing a first fixed datum plane in which the first end flap closure is effected and a second fixed datum plane in which the second end closure is effected and by moving the cartons laterally to locate the ends which are to be closed in the first and second datum planes as required. The first and second datum planes remain fixed with respect to the frame of the machine for all sizes of cartons which are being closed. This permits the adjustment of the machine to operate with cartons of different lengths by the mere adjustment of stop bars which are laterally spaced with respect to the datum planes.

Mandrel Replacement

In the adjustment of a carton loading machine for use in the loading and forming of cartons of various sizes, it is important to make the removal of the carton forming mandrels as simple as possible. In a machine of the type of the present invention, a large number of carton forming mandrels are employed and unless the removal of these mandrels is simplified, the down time required to effect the adjustment may be substantial. This difficulty has been overcome in the device of the present invention by providing a guide rail structure which serves to retain the mandrel buckets on the endless conveyor and providing a portion of the guide rail structure which is detachable within a mandrel exchange station. By removing the portion of the guide rail, the mandrels may be detached from the conveyor without the release of any individual clamping screws or the like used to secure the individual mandrels with respect to the conveyor. By use of this mechanism, the mandrels may be removed and replaced by advancing the conveyor through the bucket exchange station in a series of intermittent moves.

Blank Transfer Mechanism

In many machines for use in the handling of carton blanks, either in the blank configuration or in a knocked-down partially assembled configuration, blank transfer mechanisms are provided wherein the blank is withdrawn from the dispenser magazine and moved in a large sweeping arc to the carton loading station. The movement is in a direction which is normal to the plane of the body of the blank. This movement is difficult to control when the transfer mechanism is operating at high speed because of the wind resistance resulting from the large area of the blank. A blank which is formed with weakened fold lines may bend along the weakened fold lines as a result of the wind resistance caused during the movement of the blank so that it may not be located in the required configuration for the subsequent operation. In low-speed operations, this is not a significant factor, however, in the apparatus which the applicant has developed, in which the packages are formed by wrapping a carton blank around a mandrel containing the product which is to be wrapped, high speed operation has become very practical and the wind resistance encountered in the use of conventional mechansims is a serious limitation. The apparatus of the present invention overcome this difficulty by minimizing the extend of movement of the blank in a direction normal to the plane of the blank when it is withdrawn from the dispenser magazine and by providing for the folding of the carton blank to a prefolded configuration as it moves laterally in the plane of the body of the blank to the carton wrapping station. There is little or no wind resistance encountered in the lateral movement of the blanks. The folding of the blanks can be achieved without difficulty because plow bars, which progressively fold the blank as it is moved laterally, provide a positive folding mechansim which is not subject to difficulties associated with wind resistance.

In carton loading machines such as the machines used for end loading of cartons, it is common practice to provide a plurality of pusher units mounted on a conveyor for lateral movement with respect to the conveyor to load the product into an open carton and to discharge the loaded carton from the carton loading machine. In such apparatus, the pusher units are generally of a complex construction requiring transversely extending guide rails and the like. In contrast, the pusher units of the present invention are incorporated within the mandrel buckets and are mounted to slide with respect to the mandrel buckets to effect the lateral discharge of the partially formed package from the first conveyor. The plunger mechansim itself is inexpensive and by incorporating it is a sliding element within the mandrel, it is not necessary to provide any additional transverse supports.

Carton loading machines as a whole have previously been expensive to manufacture and complex in their construction by requiring considerable maintenance. The apparatus of the present invention represents a substantial impovement in carton loading machinery as a whole, in that, it provides a simple structure embodying two simple conveyor systems with an inexpensive form of mandrel and blade track mechanism for guiding the pusher means with respect to the mandrel to effect movement of the partially formed package. The apparatus does not require the mandrels to be moved laterally with respect to the conveyor so that the mounting mechanism for the mandrels may be in the form of simple longitudinally extending guide rails.

SUMMARY

According to an embodiment of the present invention, there is provided in a carton loading machine a carton blank dispener magazine which comprises a frame which has a dispenser opening at the front end thereof through which blanks may be withdrawn one at a time, means at the front end of the frame for withdrawing blanks one at a time through the dispenser opening, stationary blanks support rail means mounted on and extending logitudinally of such frame for supporting a plurality of generally planar carton blanks in a vertically oriented face-to-face relationship one behind the other, walking beam means mounted for movement on the extending longitudinally of the frame to underlie portions of said carton blanks, and means for cyclically driving said walking beam means from a first lowered position in which the walking beam means is spaced below the carton blanks to a second elevated position in which the carton blanks are elevated out of engagement with the stationary blank support means, and from said second position to a third position which is also an elevated position and in which the walking beam means is longitudinally advanced to urge the carton blanks supported thereon towards the dispenser opening, and from said third position to a fourth position in which the walking beam means is lowered out of engagement with the carton blanks to return the blanks to a position resting on the stationary guide rail means and from said fourth position to said first position.

According to a further embodiment of the present invention, there is provided in a wrap-around carton forming machine for forming cartons from carton blanks of the type having a main body position and end closure flaps projecting from first and second ends of the main body portion, the improvement of first conveyor means having a first end flap closure station extending in a first datum plane at a first edge thereof, second conveyor means having a second end flap closure station at an edge thereof in a second datum plane which is disposed opposite to and laterally spaced from said first datum plane, and first conveyor means having carton forming mandrels extending inwardly from said first datum plane on the side thereof remote from said second datum plane to receive carton blanks of various lengths with said first end edges of the main body portions thereof disposed in said first datum plane, second conveyor means having means disposed inwardly from said second datum plane on the side thereof remote from said first datum plane for receiving the carton blanks after closure of the first end thereof from said first conveyor and locating said second end edges of said main body portions in said second datum plane, first end closure means operative in said first end flap closure station for closing said first end of said cartons as they are moved through said first end closure station by means of said first conveyor means, second end closure means operative in said second end flap closure plane for closing said second end flaps of said cartons as they are moved through said second end closure station by means of said first conveyor means, second end closure means operative in said second end flap closure plane for closing said second end flaps of said cartons as they are moved through said second end closure station by means of said second conveyor means and means for moving said partially closed cartons laterally of said first conveyor means to said second conveyor means.

According to a still further embodiment of the present invention, there is provided in a carton forming and loading machine of the type having an endless conveyor for moving a plurality of carton forming mandrels along the frame thereof through a carton-loading station, a carton wrapping station and a carton closing station, the improvement of a mandrel exchange station in an upper longitudinal extend of the conveyor, a plurality of mandrel mounting brackets secured to said conveyor at longitudinally spaced intervals thereon for movement with said conveyor through said stations, said plurality of mandrels being secured to said conveyor means by said mounting brackets at said longitudinally spaced intervals on said conveyor and extending transversely thereof, said mandrels being adapted to be movable transversely of said conveyor into and out of said mounting engagement with said mandrel mounting brackets, guide rail means mounted on said frame and coextensive with said conveyor through said stations to cooperate with said mandrel mounting brackets to restrain mandrels mounted thereon against transverse movement with respect to said conveyor means, a portion of said guide rail means disposed within said mandrel exchange station being removable to permit removal of and mounting of mandrels located within said mandrel exchange station in response to movement of said mandrels with respect to said mounting brackets in a direction transverse of the longitudinal extent of said conveyor.

According to yet another embodiment of the present invention, there is provided in a wrapper and carton forming machine of the type having a carton wrapping station in which a carton blank is wrapped around forming mandrels which are driven through the wrapping station in a wrapping path and a carton dispenser supporting a plurality of carton blanks in a vertically oriented face-to-face relationship and having a dispenser opening at one end thereof, the improvement of transfer means for transferring flat carton blanks from said carton dispenser to said wrapping station which comprises, a frame, a carton blank conveyor means mounted on the frame and extending in a plane which intersects the wrapping path of the mandrels, said blank conveyor means having an input end disposed adjacent said dispenser opening of said carton dispenser and a discharge end adjacent the wrapping path, said conveyor means being operable to transmit carton blanks located at the input end thereof to an operable position in the wrapping path for wrapping around a mandrel as the mandrel moves along the wrapping path, carton dispenser means mounted on the frame operable to remove the carton blanks one at a time from the dispenser through the dispenser opening and to locate the carton blanks in the input end of the conveyor means and plow blade means mounted on the frame above and below the conveyor means, the plow blade means extending obliquely with respect to the plane of the conveyor means from adjacent the input end of the conveyor means to the discharge end of the conveyor means in a plane which is inclined in a direction opposite to the direction of travel of the mandrel through the wrapping station so as to fold a carton as it travels from the input end of the conveyor means to the discharge end thereof to a generally U-shaped configuration opening in a direction to receive a mandrel travelling along the wrapping path.

The present invention also provides an improvement in a wrap-around carton loading machine of the type wherein a carton blank is wrapped around a mandrel, the improvement of, a frame, an endless conveyor mounted for movement longitudinally of the frame, a plurality of mandrel buckets mounted on the conveyor for movement with the conveyor, the mandrel buckets extending transversely of the conveyor and being adapted to receive the article to be wrapped, guide track means carried by the frame for guiding the mandrel buckets longitudinally of the frame and for preventing transverse movement of the buckets with respect to the conveyor means as the conveyor means moves longitudinally of the frame, plunger means slidably mounted within each of the buckets for movement with respect to the buckets in a direction transverse of the conveyor means between a first position spaced inwardly from one end of said buckets to a second position at said one end of said buckets and guide rail means disposed above said conveyor means and engaging said plunger means with respect to said buckets between said first and second positions to discharge articles from said buckets as required.

The invention will be more clearly understood after reference to the following detailed specification read in conjunction with the drawings, wherein FIG. 1 is a plan view of a wrap-around carton loading machine according to an embodiment of the present invention;

Figure 1:
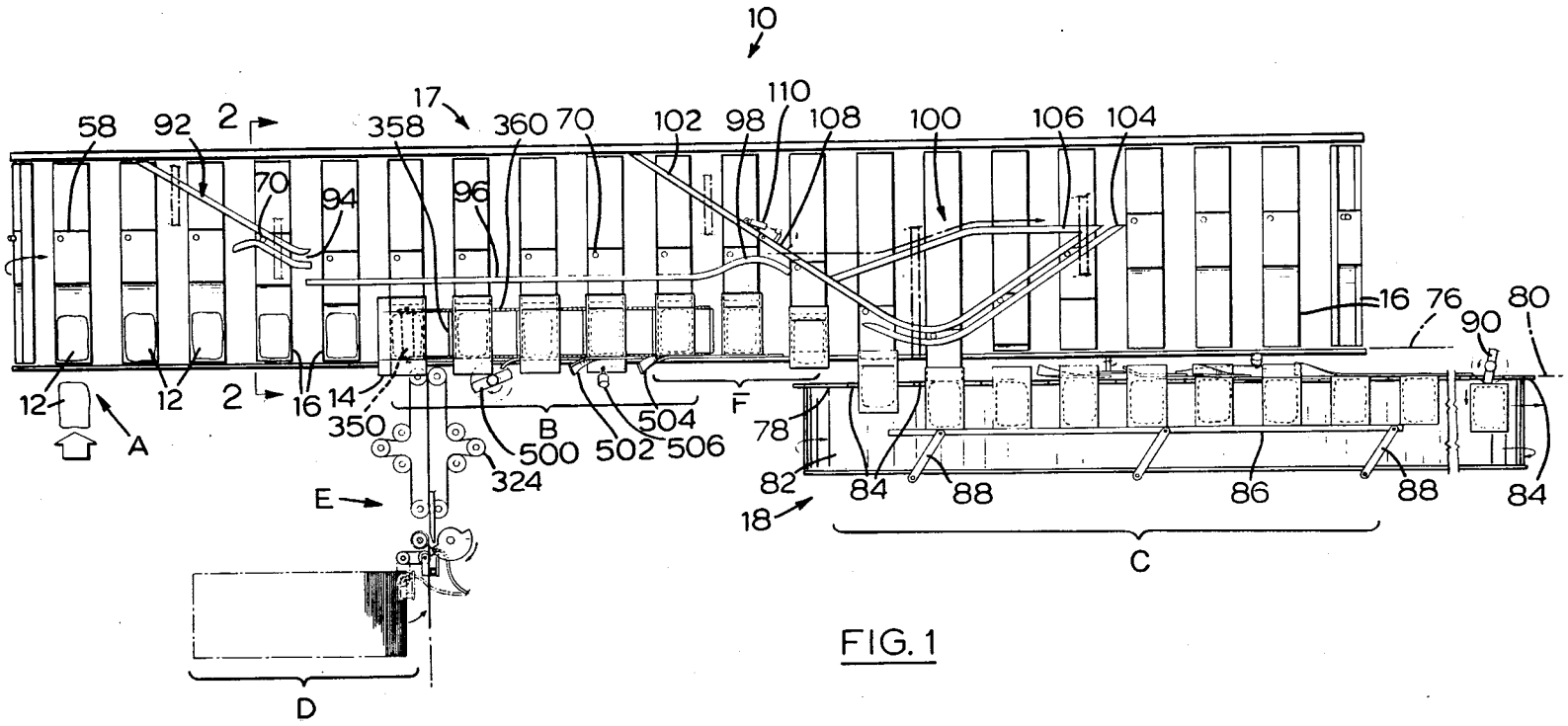
Figure 5:
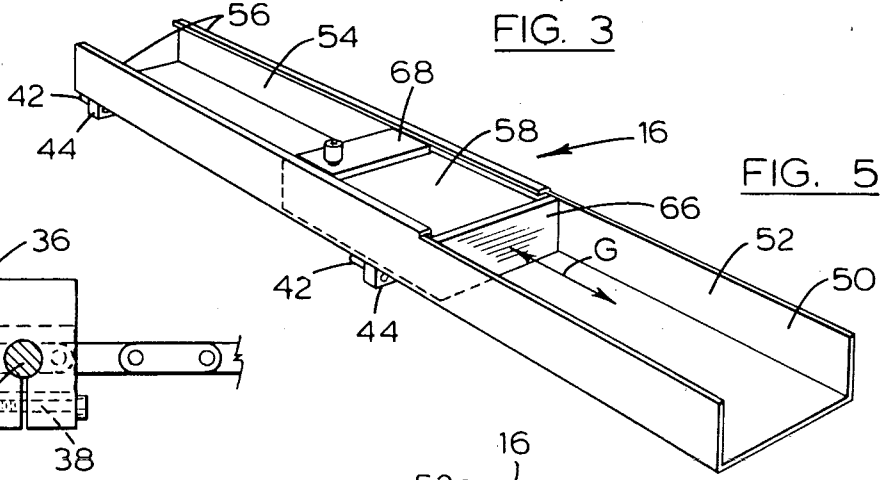
FIG. 5 is a pictorial view of a mandrel bucket according to an embodiment of the present invention.
Figure 5A:
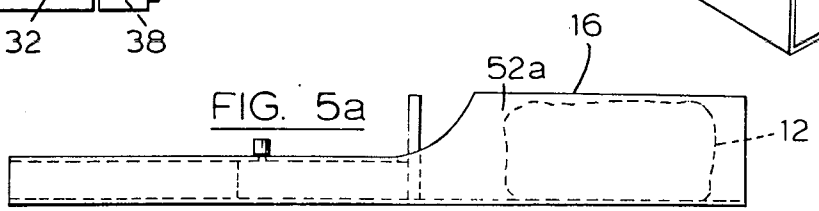
Figures 6, 7:
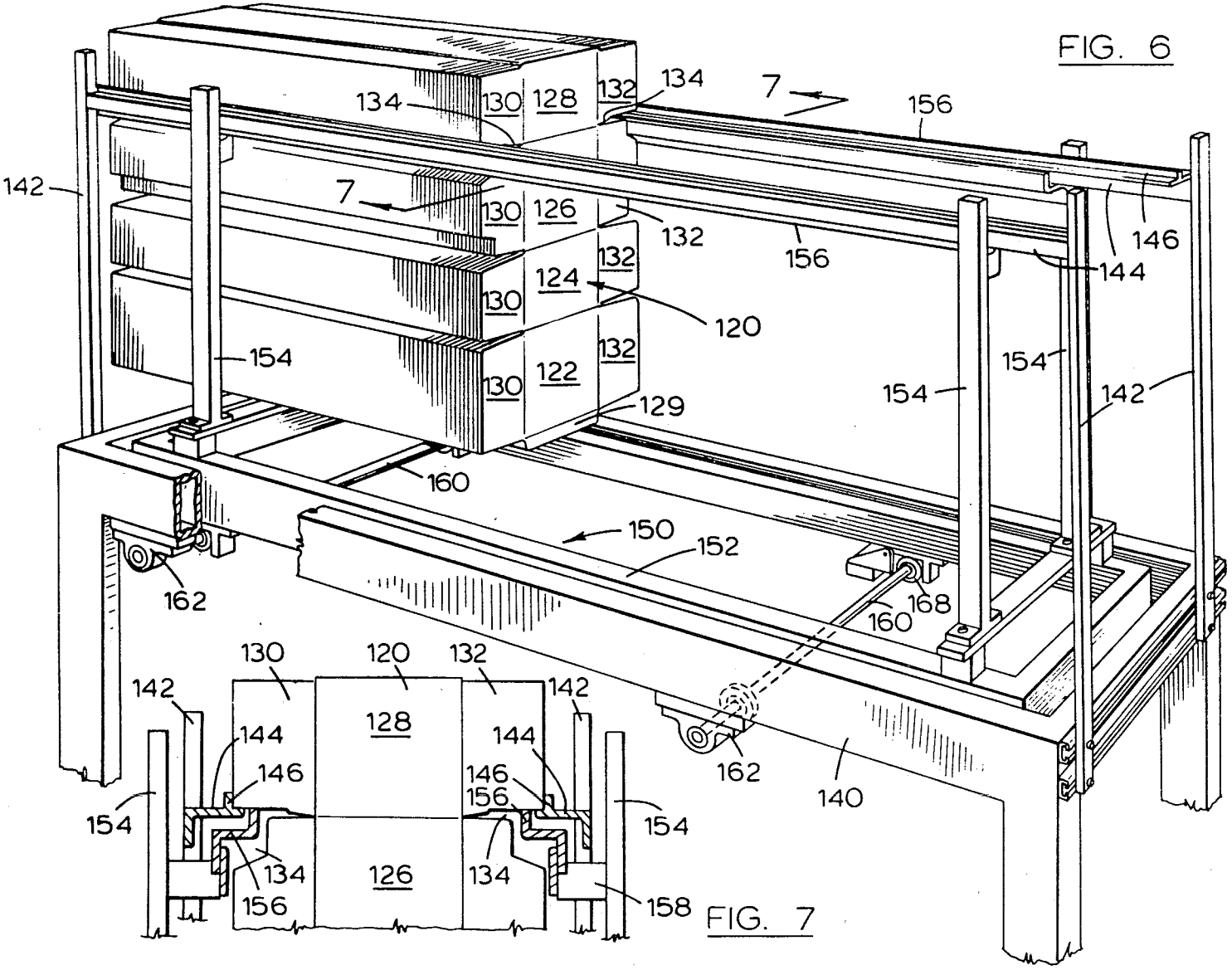
Figure 8:
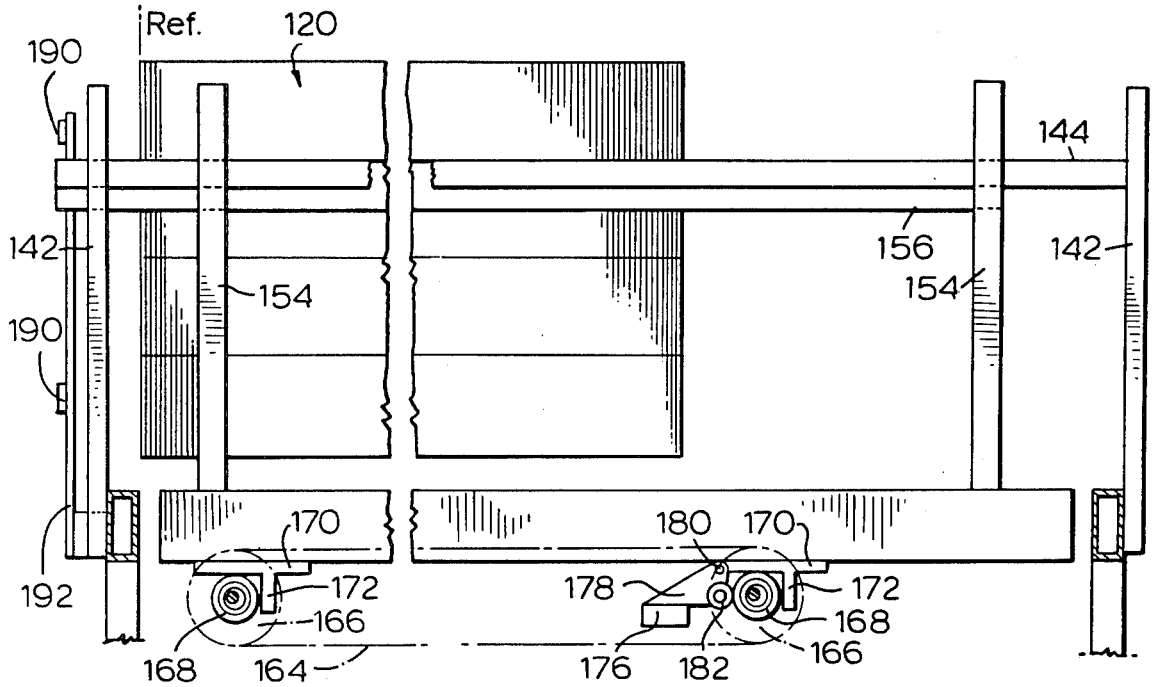
Figure 9:
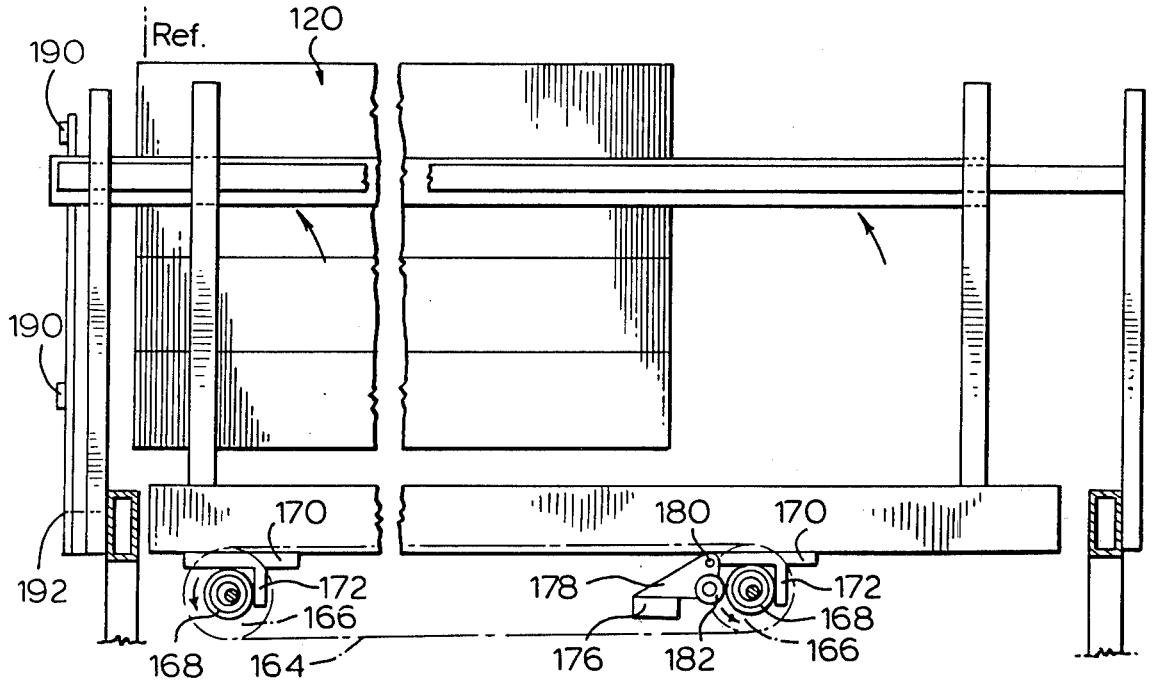
Figure 10:
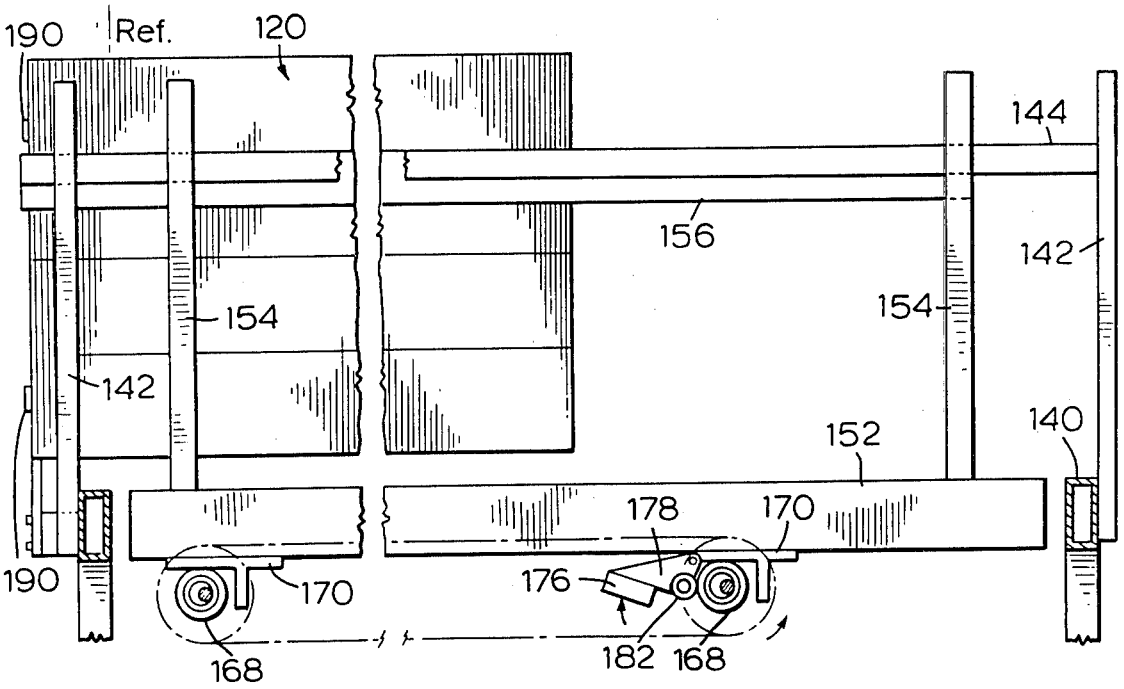
Figure 13:
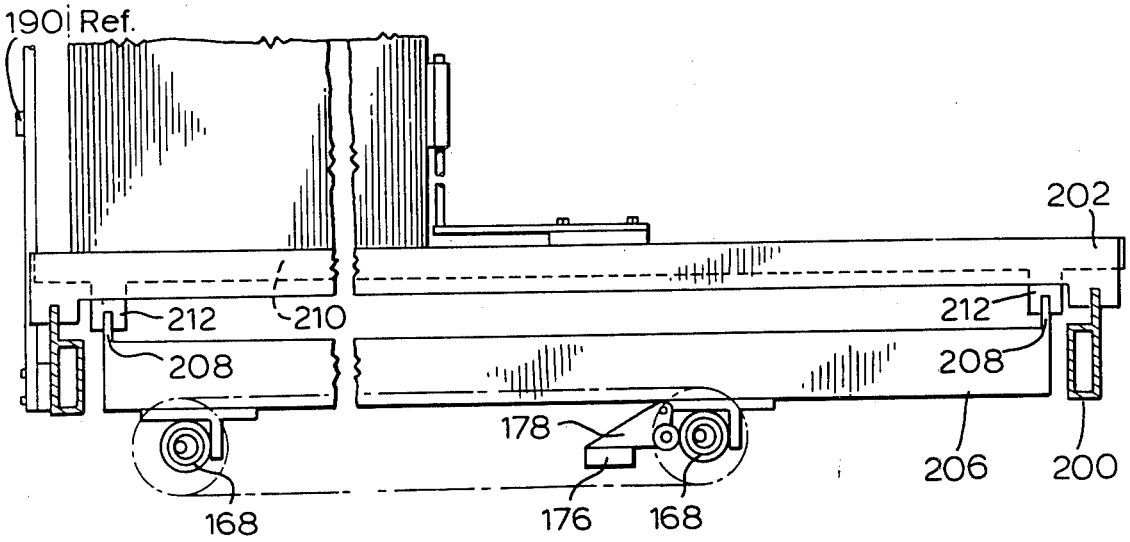
Figures 11, 12:
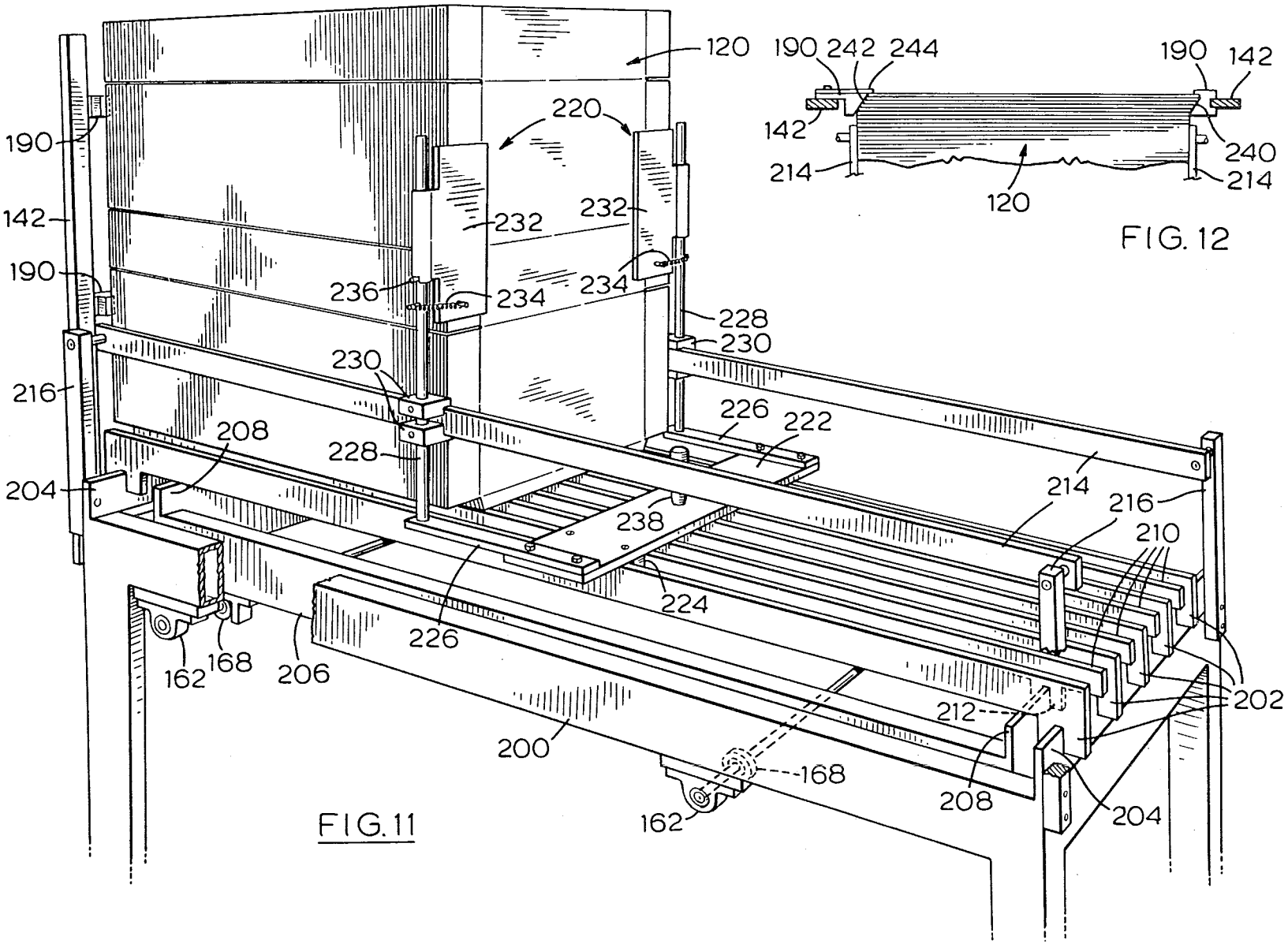
Figure 19:
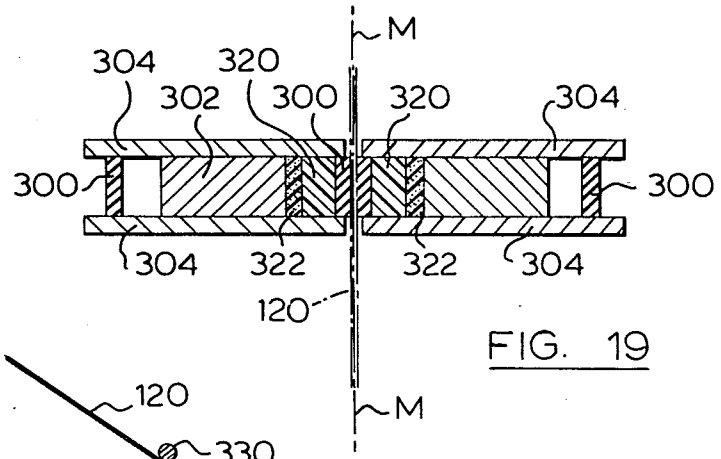
Figure 22:
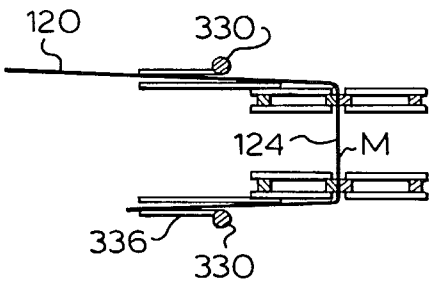
Figure 21:
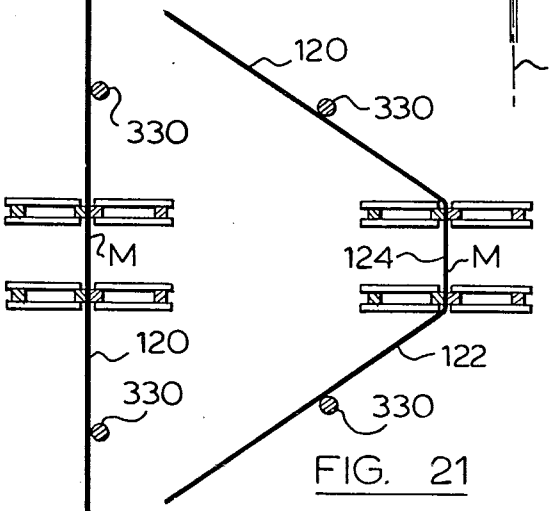
Figure 20:
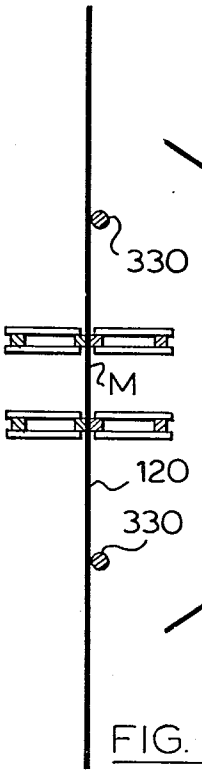
Figure 14:
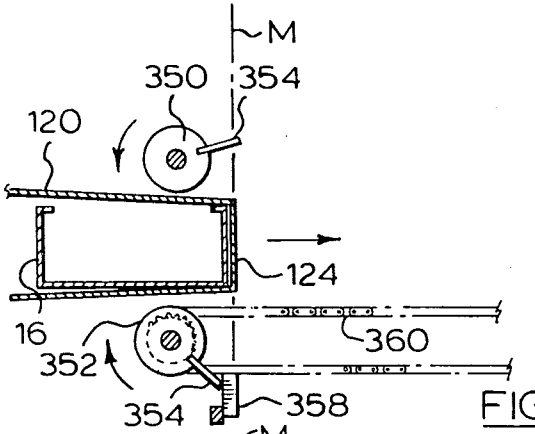
Figure 15:
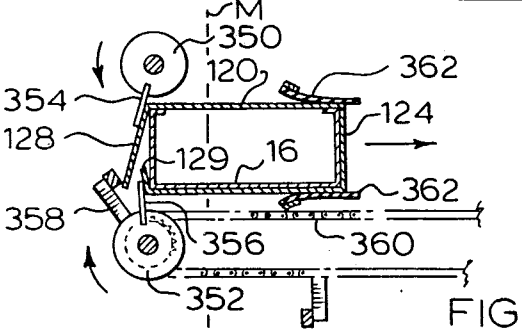
Figure 16:
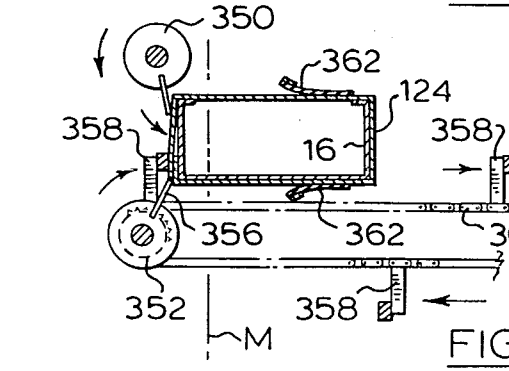
Figures 17, 18:
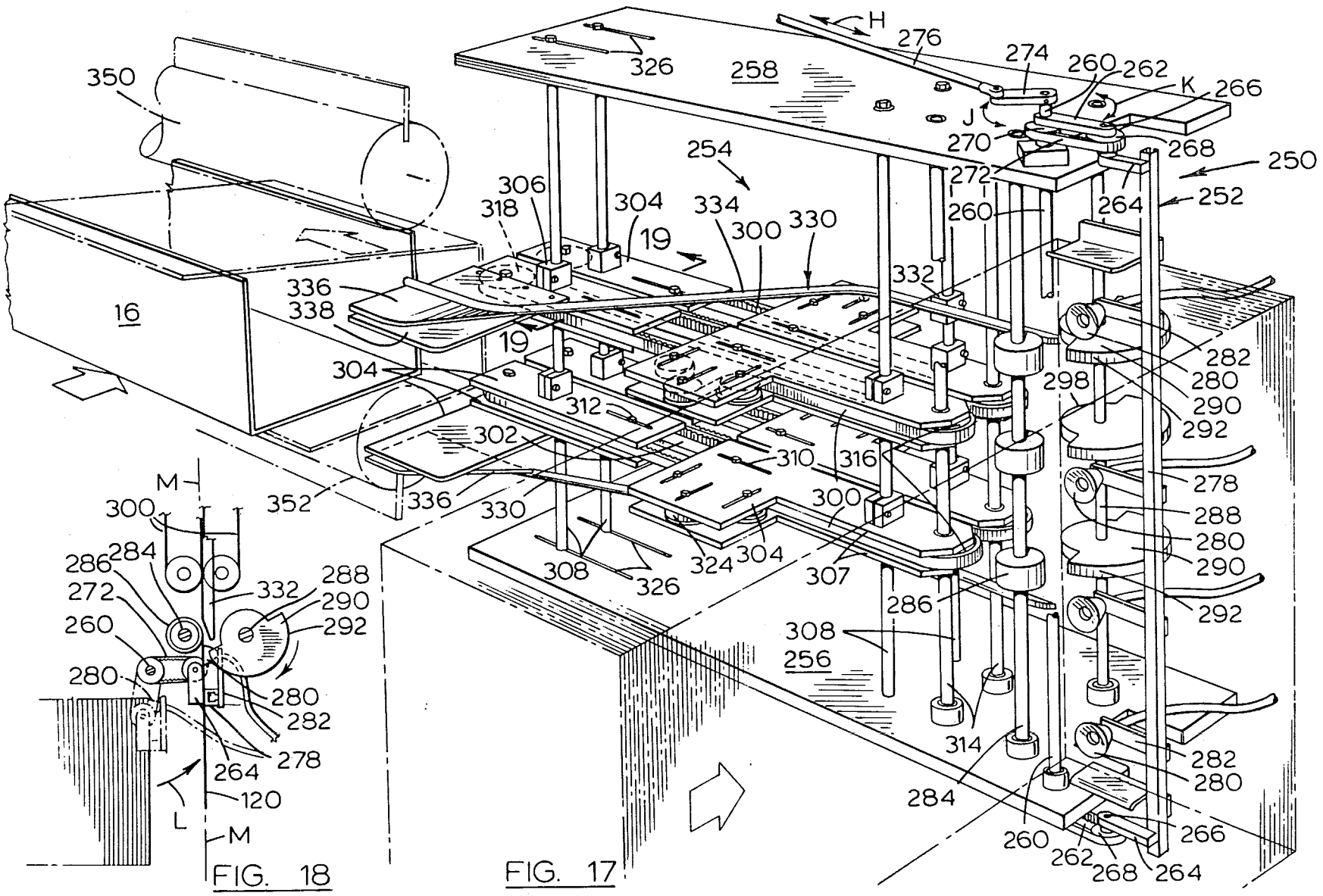

FIG. 5*a* is a side view of a mandrel bucket of a different set of buckets;

FIG. 6 is a partially sectioned pictorial view of a carton blank dispenser magazine according to an embodiment of the present invention;

FIG. 7 is a sectional view line along the line 7—7 of FIG. 6;

FIG. 8 is a side view of the carton blank dispenser magazine of FIG. 6;

FIG. 9 is a view similar to FIG. 8 showing a second position of the walking beam mechanism;

FIG. 10 is a side view similar to FIG. 8 showing a further position of the walking beam mechanism;

FIG. 11 is a pictorial view illustrating a carton blank dispenser magazine according to a further embodiment of the present invention;

FIG. 12 is a sectional view taken along the line 12—12 of FIG. 11;

FIG. 13 is a side view of the dispenser magazine illustrating a first position of the walking beam mechanism;

FIG. 14 is a partially sectioned side view of the wrapping mechanism of the apparatus of FIG. 1 illustrating a first position of the carton blank;

FIG. 15 is a view similar to FIG. 11 showing a further position in the wrapping operation;

FIG. 16 is a view similar to FIGS. 11 and 12 showing the position of two adjacent mandrels FIG. 17 is a pictorial illustration of the transfer mechanism for transferring a carton blank from the dispenser mechanism to the wrapping path of the wrapping machine;

FIG. 18 is a partial plan view illustrating the two positions of the pick-off mechansim for removing carton blanks from the dispenser magazine;

FIG. 19 is a sectional view along the line 19—19 of FIG. 18;

FIG. 20 is an end view similar to FIG. 19 showing the position of the blank when located at the input end of the conveyor of the transfer mechanism;

FIG. 21 is a view similar to FIG. 20 showing the blank in a position partially folded by means of the plow bars;

FIG. 22 is a view similar to FIG. 21 showing the position of the blank immediately prior to discharge from the transfer mechanism to the wrapping path.

A wrap-around carton loading machine according to an embodiment of the present invention is illustrated in FIG. 1 of the drawings and is generally identified by the reference numeral 10. The apparatus incorporates a number of distinct stations in which different operations are carried out. In the loading station A articles 12 are fed to the wrapping machine by means of any suitable feeding mechanism such as described in my copending application, now U.S. Pat. No. 3,879,920. The carton blank 14 is wrapped around the article 12 and its supporting mandrel 16 during passage of the mandrel 16 through the wrapping station B. The first end of the carton is also closed in the wrapping station B. The second end of the carton is closed in the second end closure station C. Carton blanks are stored in a flat configuration in the carton blank dispenser magazine D. The carton blanks are transferred from the dispenser mechansim to the carton wrapping station by means of a transfer mechanism E.

Wrap-around Carton Forming Machine

Figure 2:
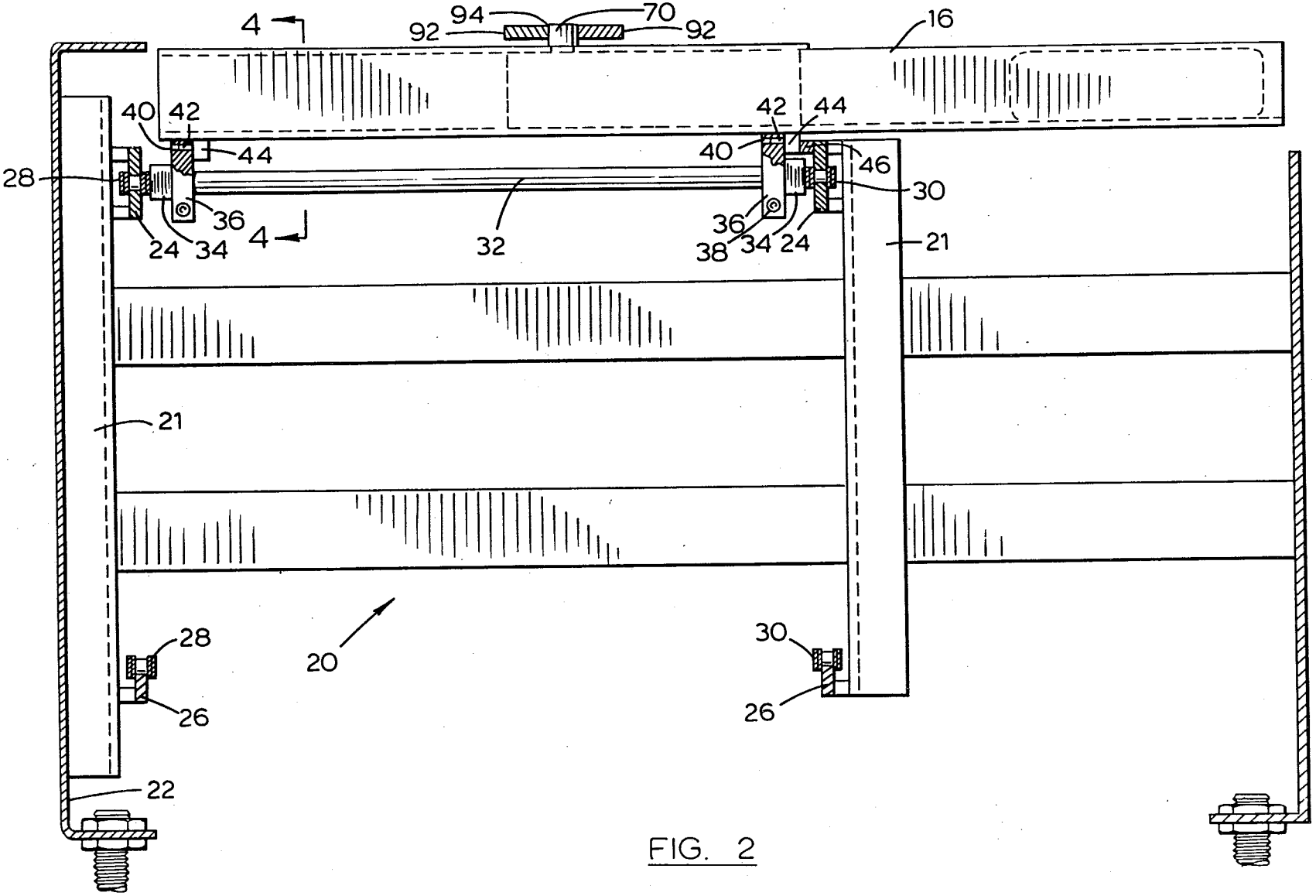
FIG. 2 is a sectional view of the first conveyor taken along the line 2—2 of FIG. 1.

Wrap-around carton forming consists of a first conveyor 17 and a second conveyor 18. The first conveyor 17 consists of a frame 20 (FIG. 2) enclosed with a housing 22. The frame supports upper guide tracks 24 and lower guide tracks 26 which are connected at their ends (not shown) to provide a continuous support for two endless chains 28 and 30.

Figure 3:
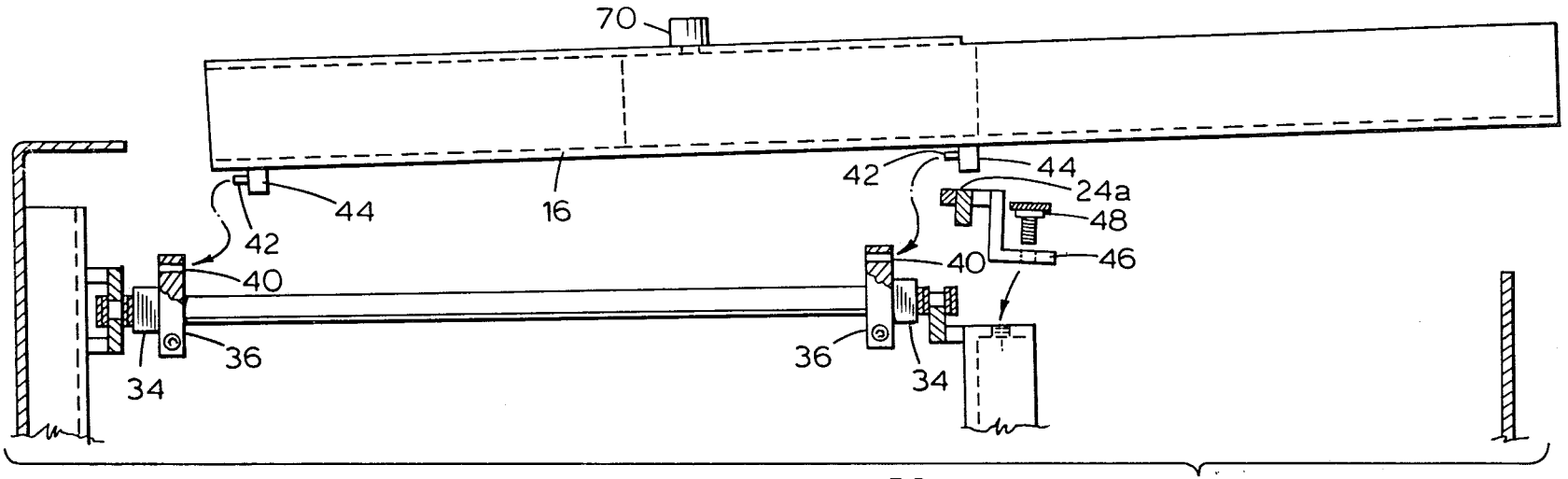
FIG. 3 is a sectional view similar to FIG. 2 illustrating the manner in which the mandrel buckets are removed.
Figure 4:
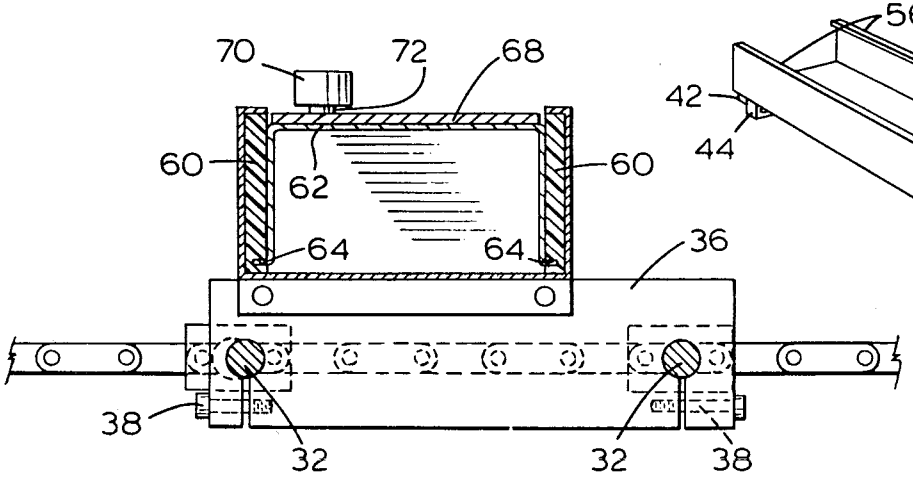
FIG. 4 is a sectional view in the direction of the arrows 4—4 of FIG. 3.

Transverse support rods 32 are connected at their opposite ends to the endless chains 28 and 30 for movement with the chains longitudinally of the frame. The transverse rods 32 are arranged in pairs closely adjacent one another as shown in pairs closely adjacent one another as shown in FIG. 4 of the drawings, one pair of transverse rods 32 being provided to support each bucket 16. The rods 32 are mounted on brackets 34 at either end thereof which serves to secure the rods with respect to the chains 28 and 30 in a well known manner. Mandrel mounting brackets 36 are secured at each end of each set of transverse rods 32. Mandrel mounting brackets 36 are secured with respect to the transverse rods 32 by means of a clamping screw 38. The mandrel mounting brackets 36 have passages 40 opening inwardly from one face thereof to receive dowel pins 42 which are mounted on the underside of the buckets 16 by means of transverse brackets 44. When the mandrels 16 are mounted on the mandrel mounting brackets 36, it is important to prevent transverse movement of the buckets with respect to the mounting brackets. This is achieved by providing an extension 46 to the guide track 24 which projects towards the bracket 44 which extends downwardly from the bucket 16 to prevent withdrawal of the pins 42 from the passages 40. As shown in FIG. 3 of the drawings, a portion of the guide track 24*a* is mounted on a bracket 46 which is releasably secured with respect to the frame 20 by means of locking screws 48. When the detachable portion 24*a* of the guide rail is removed, the mandrel 16 may be located on or removed from the mandrel mounting brackets 36. The detachable portion 24*a* of the guide rail 24 is located in the bucket exchange station F (FIG. 1) and buckets may be removed and replaced by buckets of a different set by advancing the conveyor in a series of intermittent stages through the bucket exchange station F. The chains 28 and 30 are driven longitudinally of the frame by means of a suitable drive means (not shown) in a conventional manner.

Mandrels

With reference to FIG. 5 of the drawings, the reference numeral 16 refers generally to a mandrel bucket according to an embodiment of the present invention. The mandrel bucket consists of a U-shaped channel member 50 which is preferably made from sheet metal such as stainless steel. The bucket 50 has a front end portion 52 and a back end portion 54. A short flange 56 projects inwardly from the upper edges of the side walls of the bucket at the back portion 54 thereof. The front end portion 52 of the mandrel provides an article receiving compartment which is open at the upper end thereof to permit an article to be trapped into the compartment and at the front end thereof to permit an article to be discharged from the compartment therethrough. As previously indicated, mounting brackets 44 with their associated mounting pins 42 project downwardly from the mandrel 16 in the area of the back portion 54 thereof. These brackets, as previously described, serve to support the mandrel 16 on the first conveyor mechanism. The front portion 52 of the mandrel projects laterally outwardly from the frame which supports the conveyor so that a carton blank may be wrapped around the forward end of the mandrel without encountering any obstructing supporting frame structure. It will be understood that the proportions of the bucket will be determined by the proportions of the carton and the article which is to be loaded into the carton. The peripheral proportions of the front end portion 52 of the mandrel will determine the shape to which the carton is deformed during the wrapping operation. As shown in FIG. 5*a* of the drawings, the front portion 52*a* of the mandrel may be enlarged to accommodate a larger package and carton. While FIG. 5 of the drawings illustrates an enlargement of the mandrel in the vertical plane, it will be understood that the enlargement may also be in the transverse plane. Transverse enlargement may be achieved by forming a channel member which is wider over its full length or by providing a channel member which is wider over the front end portion 52*a* thereof only. As previously indicated, one set of mandrels may be removed and replaced by a second set of mandrels without difficulty.

A plunger 58 is slidably mounted within each mandrel bucket for movement in the direction of the arrow G. The flanges 56 at the inner end portion 54 of the U-shaped channel member 50 serve to retain the plunger 58 therein when the mandrels are inverted during their movement along the guide rails of the carton forming machine. The plunger 58 consists of a pair of side plates 60 formed from a low friction material such as Teflon or the like. The end plates 60 are located in a close fitting sliding relationship with respect to the side walls, the bottom wall and the flanges 56 of the channel shaped member 50. The side walls 60 are maintained in the close fitting sliding relationship with respect to the side walls by means of a bridge member 62 which is preferably made from sheet metal such as stainless steel and which has outwardly directed flanges 64 at the lower edge thereof which are locked within slots provided in the side wall members 60. An end plate 66, preferably made from a plastic material such as Teflon, is located at the front end of the plunger member 58 and secured with respect to the side wall members 60 by any suitable means such as clamping screws or by means of an adhesive. A top plate 68 in the form of a metal plate is rigidly mounted with respect to the bridge member 62 and serves to support a roller member 70 thereon. The roller member 70 is mounted for rotation with respect to its support shaft 72. It will be apparent that the structure of the pusher member 58 is relatively simple so that the pusher members are inexpensive to manufacture. Furthermore, the Teflon side walls 60 may be replaced very easily in the event or wear through long use. The use of a large area of bearing surface in the mounting of the pusher member 58 serves to minimize the amount of wear which will occur as a result of extensive use of the apparatus. The resilient bridge member 62 also serves to ensure that the side walls 60 are maintained in a close fitting sliding relationship with respect to the side walls of the channel. It will be apparent that the structure of the combination plunger and mandrel buckets is relatively simple, in that, the bucket provides all of the guide track required to guide the plunger with respect to the article receiving compartment. The plungers 58 are moved to and fro in the direction of the arrow G by the guide track which is disposed above the first conveyor mechanism, as will be described hereinafter.

Fixed End Closure Datum Planes

As previously indicated, the mandrel buckets 16 are restrained against transverse movement with respect to the first conveyor. It follows that the open front ends of the buckets extend in a straight line as they pass along the first conveyor. This straight line is utilized in the apparatus of the present invention as a first datum plane 76 (FIG. 1) in which the first end of the carton is closed by end flap closure means in the wrapping station B. The second conveyor 18 has an inner edge 78 disposed in a spaced parallel relationship with respect to the first datum plane 76. The inner edge 78 provides a second datum plane 80 disposed in a spaced parallel relationship with respect to the first datum plane 76. The upper end of the carton is closed as it is driven along the second datum plane by the second conveyor 18. The end closure means used for closing the second end is in the form of a conventional rotary deflector blade and plow bars used in combination with an adhesive applicator in a well known manner. The second conveyor 18 is in the form of an endless conveyor belt 82 which has a plurality of upstanding posts 84 mounted thereon at the inner edge 78. The posts 84 are spaced from one another longitudinally of the second conveyor 18 a distance at least equal to the maximum width of the cartons which are to be wrapped. The second conveyor is supported with the upper extent thereof in the plane of the upper extent of the first conveyor 16 by means of a suitable frame structure (not shown) and is driven at the same speed as the first conveyor 16 in the same direction as the first conveyor 16 by suitable drive means (not shown). The compartments formed between adjacent vertical posts 84 are aligned with the mandrels carried by the first conveyor so that the partially closed wrapper and its contents may be transferred from the mandrels into the compartments formed on the second conveyor for continued travel through the second flap closure station C. An important feature of the apparatus of the present invention is that the spacing between the first datum plane 76 and the second datum plane 80 is not adjusted when adjustments are made to accommodate cartons of different lengths. A carton of any length up to a predetermined maximum length may be wrapped around the mandrels by discharging the carton into the wrapping path such that the fold lines which connect the end closure flaps to the main body of the carton at the first end thereof are disposed in said first datum plane 76. The length of the carton which extends inwardly with respect to the first conveyor 16 from the datum plane 76 may be any length up to the extent of the lateral overhang of the mandrels with respect to the upright members 21 of the frame 20. The pusher units 58 which, as previously described, are slidably mounted within the mandrels serve to locate the second end of the carton with respect to the second datum plane 80. The pusher units 58 are withdrawn from the first datum plane a distance sufficient to accommodate the longest carton regardless of the size of the carton which is in fact being wrapped. When the first end of the carton has been closed in the first wrapping station, the plunger is moved laterally of the first conveyor to engage the package which forms the content of the carton which in turn engages the closed end of the carton and moves the carton laterally off of the mandrel into the aligned compartment of the second conveyor 18. The lateral movement of the plungers 58 is such that the outer end of the plungers 58 extend to at least the second datum plane 80. A stop bar 86 is mounted above and extends longitudinally of the second conveyor 18 is a spaced parallel relationship with respect to the second datum plane 80. The stop bar is supported by adjustable link arms 88 so that the position of the stop bar 86 with respect to the datum plane 80 may be adjusted. The links 88 are supported by the frame (not shown) of the second conveyor 18 in a conventional manner. The adjustment of the stop bar 86 is achieved by moving the stop bar 86 longitudinally of the second conveyor so that it moves towards or away from the second datum plane 80 as required. The position of the stop bar 86 is adjusted to accommodate cartons of different lengths. This is the only adjustment which is required in order to accommodate cartons of different lengths. The distance between the second datum plane 80 and the stop bar 86 is equal to the length of the main body portion of the cartons such that the flaps of the cartons are disposed on the opposite side of the second datum plane so that the end flaps at the second end of the carton may be closed as the cartons are transported through the second end closure station C by means of the second conveyor 18. A rotary kicker blade 90 is located adjacent the discharge end of the second conveyor 18 and serves to push the closed carton laterally of the second conveyor 18 out of engagement with the vertical posts 84 so that the carton may drop freely from the second conveyor int o a suitable receptacle.

The plungers 58 are positioned with respect to the first conveyor 16 by means of an overhead cam track system which is supported by the frame which is shown in part in chain lines in FIG. 1 of the drawing but which is not shown in detail in order to avoid over complication of the drawings. The cam track includes a first pair of guide rails 92 which define a passage 94 which receives the follower roller 70 of the pusher unit in a free fitting sliding relationship. The passage 94 is angularly inclined toward the second datum plane 76 to move the pusher unit 58 laterally towards the first datum plane 76. If the article 12 has been loaded into the mandrel in a position spaced a substantial distance inwardly from the datum plane 76, this first adjustment of the position of the plunger 58 will serve to locate the article 12 in a position wherein it will be fully enclosed by the carton blank during the wrapping operation. A further guide rail 96 extends longitudinally through the carton wrapping station B and the first end closure station F. The guide rail 96 is disposed in a spaced parallel relationship with respect to the first datum plane 76 during its extent through the carton wrapping station B and has an outwardly convexed portion 98 at the trailing end thereof disposed within the end closure station F. The rail 96 merely serves to ensure that the pusher units 58 are not advanced towards the first datum plane 76 during the wrapping operation. The rail 96 may be rigidly secured with respect to the frame of the machine as it is disposed in a position to accommodate the minimum size of package which will be wrapped by the machine. A third guide rail assembly 100 consists of guide rails 102, 104 and 106. The guide rail 102 has a first extent which extends obliquely across the first conveyor in a direction towards the first datum plane 76. A small gate 108 is formed in the first extent of the first guide rail 102. The gate 108 may be opened or closed by means of a hydraulic cylinder 110 to cause the follower 70 of a pusher unit to pass through the opening formed in the rail 102 by opening the gate 108 or to cause the roller 70 to follow the angular inclination of the guide rail 102 when the gate is closed. The gate is operated by a suitable detector means (not shown) which serves to detect the presence or absence of a wrapper or its contents so that the plunger 58 will pass through the open gate if the wrapper or its contents are not located on the mandrel associated with the plunger such that the wrapper or the contents will be discharged at the discharge end of the first conveyor and not transferred to the second conveyor. When the roller 70 passes through the open gate 108 it engages the guide rail 100 so as to be aligned at the discharge end of the first conveyor with the rollers of the other plungers as will be described below.

When a mandrel is loaded and the first end of the carton is closed, the detector mechanism will function to maintain the gate 108 in a closed position. The forward movement of the first conveyor will cause the roller 70 to move along the first guide rail 102 so that the plunger moves laterally with respect to the mandrels to position the partially closed carton in a compartment of the second conveyor. The plunger 58 is withdrawn as the rollers 70 engage the guide ral 104. The rollers 70 are released from the guide rail 104 in a position in which they are withdrawn to a sufficient extent to ensure that the plungers are located within the mandrel to an extent that they are secured against removal from the mandrel by means of the flanges 56 formed at the upper edge of the mandrel. The pusher units are also withdrawn to an extent sufficient to receive the largest package which may be wrapped by the apparatus in use.

If it is necessary to employ plunger units 58 of different lengths, the first guide rail section 92 may be mounted with respect to the frame of the machine for lateral adjustment thereof so that the position of the plungers at discharge therefrom may be adjusted towards and away from the second guide rail bar 96. Similarly the entire assembly of the third guide rail assembly 100 may be moved laterally with respect to the frame of the machine to adjust the position of the various guide tracks to locate the plunger units at any required position.

Carton Blank Dispenser Magazine

Two embodiments of a carton dispenser magazine according to the present invention are illustrated in FIGS. 6 to 13 of the drawings. The first embodiment is illustrated in FIG. 6 through 10 and the second embodiment is illustrated in FIGS. 11 to 13. The different embodiments are distinguished by the fact that in the first embodiment the carton blanks are supported from a plane disposed above the center of gravity thereof while in the second embodiment the carton blanks are supported at their lower edges.

With reference to FIG. 6 of the drawings, reference numeral 120 refers to generally to a carton blank of a type suitable for use in a carton dispenser magazine of the type of the first embodiment described herein. The blank consists of a main body portion formed from four panels 122, 124, 126 and 128 having end flaps 130 and 132. In accordance with common practice in the construction of carton blanks, notches are formed between the adjacent edges of the end flaps. In particular, a large notch 134 is formed between adjacent end flaps of the panels 126 and 128 of the main body. The notches 134 are disposed on one side of the center of gravity of the panel which would normally be disposed closely adjacent the fold line connecting the panels 124 and 126 of the main body. It follows that if the blanks 120 are supported to hang freely from support bars located within the notches 134, the blanks will hang in a perpendicular configuration.

The carton dispenser magazine comprises a support frame 140 from which four support columns 142 project upwardly. The support columns 142 are rigidly secured with respect to the frame 140. Longitudinally extending support rails 144 are secured to support posts 142 at opposite ends of the frame 140 and extend longitudinally thereof in a position spaced above the frame 140. The rails 144 are disposed in a spaced parallel relationship and have an inwardly directed L-shaped ledge 146 at the inner edge thereof adapted to support a lower edge of the end flaps 130, 132 of the carton blank 120 as shown in FIG. 7 of the drawings. The guide rails 144 are stationary and provide a stationary blank support rail for supporting the carton blanks in a vertical face-to-face relationship. A walking beam mechanism generally identified by the reference numeral 150 is used to advance the carton blanks toward the dispenser opening. The walking beam mechanism includes a rectangular shaped base 152 which is proportioned to fit within the base 140 and which has a length which is sufficiently smaller than the frame 140 to permit longitudinal movement of the base 152 with respect to the base 140. Support posts 154 are rigidly mounted on the base 152 and project upwardly therefrom. The support posts 154 at the rear end of the frame 152 are connected to the support posts 154 at the front end thereof by longitudinally extending support rails 156. The support rails 156 are secured with respect to the vertical posts 154 by means of brackets 158 which project inwardly from the posts 154 to dispose the support rails 156 inwardly of the support rails 144. The support rails 156 have an inner edge disposed inwardly of the L-shaped support surface 146 of the rails 144 for engagement with the edges of the end flaps 130 and 132 of the carton 120 as will be described hereinafter.

The walking beam mechanism is supported with respect to the frame 140 by means of a pair of support shafts 160 which are mounted on the frame 140 for rotation in journals 162. The shafts 160 are rotatably driven by suitable drive means (not shown) and are connected to one another for synchronized rotation by a chain 146 (FIG. 8) which extends about sprockets 166 carried by the shafts 160. Eccentric cams 168 are mounted on the shaft 160 and are rotatably driven in response to rotation of the shafts 160. Four mounting brackets 170 are mounted on the underside of the frame 152 of the walking beam assembly and rest upon the eccentric cams 168. The mounting brackets 170 each have a fixed vertically extending portion 172 projecting downwardly therefrom. The fixed portions 172 of the brackets are dispposed on the side of the cam which is opposite to the dispenser end of the magazine. A weight 176 is mounted at the outer end of an arm 178 which is pivotably mounted on the mounting bracket 170 by means of a pivot pin 180. A roller 182 is mounted on the arm 170 and is held in engagement with the eccentric cam 168 by the weight of the weight 176.

In use, the walking beam mechanism is movable from a first position in which the movable support rail 156 is disposed below and spaced downwardly from the edge of the carton blank which is supported by the stationary support rails 144. The rotation of the eccentric cam 168 causes the walking beam assembly to be elevated with respect to the stationary frame 140 to an extent sufficient to cause the guide rails 156 to lift the carton blanks out of engagement with the stationary guide rails 144. Continued rotation of the cams 168 cause the walking beam frame to be advanced in a direction towards the dispenser end of the magazine. Further rotation of the cam 168 causes the walking beam assembly to be lowered with respect to the stationary frame to return the carton blanks to a position resting on the stationary support rails 144.

When the cartons are in position at the discharge end of the magazine such that it is impossible to move the assembled stack of cartons closer to the discharge end, the stack of cartons provides a resistance which acts against the forward advancement of the walking beam mechanism in a direction towards the discharge end of the magazine. When this resistance increases above a predetermined level, the rotation of the cam 168 will lift the weight 176 as shown in FIG. 10 of the drawings, with the result that the walking beam assembly will not be moved longitudinally in a direction of the discharge end of the dispenser. This structure provides a mechanical release mechanism which is not controlled by pressure-sensitive switches at the discharge end fo the dispenser mechanism and is not dependent solely upon pressure at the discharge end.

In use a plurality of carton blanks are positioned on the support rails by passing the blanks inwardly of the assembly through the open input end thereof with the support rails 144 and 156 extending into the notches 134. The walking beam mechanism is then set in motion by rotatably driving the cams 168. Initially the load of carton blanks 120 may be spaced a substantial distance from the stops 190 which are located at the discharge end of the dispenser magazine. The stops 190 are in the form of short laterally extending lugs which project tangentially from support columns 192 and opposite sides of the dispenser opening of the magazine. One rotation of the walking beam mechanism will advance the stack of cartons from the reference position shown in FIG. 8 of the drawings to the position shown in FIG. 9 of the drawings and successive rotations of the walking beam mechanism will continue the advancement of the cartons until the cartons are located in the position shown in FIG. 10 of the drawings. In this position futher movement of the cartons towards the dispenser end is prevented by the stops 190 and the clutch mechanism operates to lift the weight 176 to prevent movement of the walking beam mechanism in a direction towards the discharge end. In view of the simple structure of the releasable clutch mechanism it is possible to operate the drive mechanism for the walking beam continuously so that when the clutch is operable to prevent movement of the walking beam mechanism towards the discharge end, the carton blanks are repeatedly raised and lowered with respect to the stationary support beam means. This repeated raising and lowering of the carton blanks serves to free any cuttings which may be located between adjacent carton blanks as a result of the production procedures involved in the cutting and forming of the blanks. In addition, by reason of the fact that the blanks are supported from an arch which is disposed above the center of gravity, the rearmost blanks in the stock are self-supporting and will not tend to fall backwards away from the remainder of the stack. This is a problem which is experienced with conventional magazines in which the blanks are supported from the lower edge thereof. For this reason, it is not necessary to provide any back-up support for the last blank in the stack of blanks. Nevertheless, a mechanical pusher mechanism may be added if required to ensure that the blanks are given an additional push towards the discharge end thereof. The mechanical pushing mechanism may be in the form of a weighted member mounted to slide with respect to the frame of the dispenser mechanism in a direction towards the discharge end thereof to engage the last blank in the stack and push it towards the discharge end. A carton blank dispenser according to a further embodiment of the invention is illustrated in FIG. 11 of the drawings. The frame 200 is substantially the same as the frame 140 of the embodiment illustrated in FIG.

6 of the drawings. The principal difference in structure in this embodiment is that the walking beam mechanism and the stationary support rails are disposed below the lower edge of the carton blanks 120. The stationary rails 202 extend longitudinally of the frame and are releasably secured with respect to the frame. The rails 202 are notched at either end thereof and are received in notches in the transverse support plates 204 of the frame 200. The stationary guide rails are thereby locked with respect to the transverse beams 204 against longitudinal and transverse movement. The walking beam mechanism consists of a generally rectangular frame 206 which has upstanding ledges 208 at either end thereof. The walking beam member in the form of longitudinally extending rails 210 which extend longitudinally of the frame and have downwardly directed lugs 212 at either end thereof. The lugs 212 and the transverse ledges 208 are formed with complementary notches such that the rails 210 may be secured with respect to the walking beam against longitudinal and lateral movement. Again, the walking beam frame 206 is driven with respect to the stationary frame 200 and its associated stationary rails 202 by means of an eccentric cam 168. The drive mechanism also incorporates the releasable clutch mechanism described with respect to the embodiment illustrated in FIG. 6 of the drawings including the weight 176 and the pivoted arm 178. The operation of the walking beam mechanism in terms of the raising longitudinal advancement lowering and longitudinal retraction of the walking beam mechanism with respect to the stationary mechanism is that previously described. In this embodiment, however, the lateral support of the side edges of the cartons is by means of a pair of longitudinally extending side rails 214 which are supported by the stationary frame 200 by means of vertical support posts 216.

The rearmost carton blank in the stack of blanks is supported in an upright position by means of a mechanical support generally identified by the reference numberal 220. The support consists of a base plate 222 which extends transversely of the support rails 202 and 210 and has lugs 224 secured to the underside thereof which project downwardly therefrom to engage the walking beam rails 210 in a close fitting relationship.

A pair of arms 226 are secured to the base plate 222 and project forwardly therefrom. A pair of support posts 228 are secured at the front end of the arms 226 and project upwardly therefrom. A pair of slide brackets 230 are carried by each of the arms 228 and slidably engage the outer upper and lower edges of the side rails 224 in a close fitting sliding relationship. A pair of swing flaps 232 are hingedly mounted at the upper ends of the support arms 228 and project inwardly therefrom. A coil spring 234 extends between the flaps 232 and the posts 228. The flaps 232 are movable from the position shown in FIG. 11 of the drawings inwardly toward the discharge end of the magazine by extending the spring member 234. A stop in 236 is provided on each of the arms 228 to prevent movement of the flaps 232 with respect to the arms 228 in a direction towards the input end of the magazine beyond the transversely extending position shown in FIG. 11 of the drawings. The flaps serve to support the rearmost carton in an upright position and the base plate 222 is advanced with the advancing cartons by the same action of the walking beams 210 that advances the cartons. A handle 238 issecured to and projects upwardly from the base plate 224. The entire assembly 200 may be moved with respect to the frame on the dispenser magazine by manually engaging the handle 238 and sliding the assembly 220 longitudinally of the frame. In order to load the cartons into the machine while it is in operation, a plurality of cartons are located behind the flaps 232, the handle 238 is manually engaged and the assembly is moved rearwardly while the cartons are held manually closely adjacent the stack of cartons which are already in the magazine. The flaps 232 pivot about the post 228 to permit the assembly to move rearwardly and once the flaps 232 are located rearwardly of the blanks which are being added, the springs 234 cause the flaps to return to the inwardly directed position and thereafter the assembly 222 is advanced towards the discharge end to tightly position the newly added blanks with respect to the original stack of blanks.

With reference to FIG. 12 of the drawings, it has been found that the removal of the blanks from the stack of blanks can be facilitated by causing the blanks at the discharge end of the magazine to be laterally displaced with respect to one another a short distance. This may be achieved by providing angularly inclined surfaces 240 and 242 on the brackets 190. One of the brackets 190 is formed with a fixed notch and the other bracket has a spring clip 244 which is movable as a carton blank is withdrawn from the dispenser opening. It has been found that by effecting this slight lateral movement of the blanks prior to discharge from the dispenser opening, the leading blank is released from the following blank and this facilitates the one by one removal of the blanks from the stack of blanks.

Transfer Mechanism

Carton blanks are removed from the dispenser mechanism and deposited in the wrapping path by means ofthe transfer mechanism generally identified by the reference numeral 250. The transfer mechanism is located in the transfer station E in a plane which extends normal to the plane of the first conveyor mechanism and which intersects the wrapping path of the mandrels as they travel longitudinally of the first conveyor. The transfer mechanism 250 includes a blank pick-off mechanism 252 and a blank transverse feeding mechanism 254. The transfer mechanism includes a support frame (not shown) which supports a base plate 256 above which a similar top plate 258 is located by the various shafts extending therebetween as will be described hereinafter. The pick-off mechanism 252 includes a shaft 260 which is journalled at opposite ends thereof in the plates 256 and 258. The link arms 262 are mounted at opposite ends of the shaft 260 and project radially outwardly therefrom. A second link arm 264 is pivotally mounted on a shaft 266 carried at the outer end of the first link arm 262. A pulley 268 is secured with respect to the outer link arms 264 and is connected to a pulley 270 which is secured with respect to the shaft 260. A twist drive belt 272 connects the pulleys 268 and 270. A lever arm 274 is secured at the upper end of the shaft 260. A shaft 276 is secured at the outer end of the lever arm 274. The shaft 276 is reciprocally driven to and fro in the direction of the arrow H by means of a suitable drive means which is synchronized with respect to the movement of the first conveyor means. Movement of the shaft 276 in the direction of the arrow H causes reciprocating arcuate movement of the lever arm 274 in the direction of the arrow J. Movement of the arm 274 causes arcuate rotation of the rod 260 which in turn causes movement of the link arm 262 in the direction of the arrow K. A longitudinal bar 278 extends between the outer ends of the outer link arms 264. A plurality of suction cups 280 are mounted on arms 282 which project from the longitudinal member 278. Movement of the link arms 264 moves the suction cups 280 to and fro between the position shown in solid lines to the position shown in broken lines in FIG. 20 of the drawings. When the suction cups are in the position shown in broken lines in FIG. 20 of the drawings, a vacuum is applied to the cups so that upon movement in the direction of the arrow L the suction cups will pull one carton blank out of the stack of carton blanks through the dispenser opening of the carton dispenser magazine. The blank 120 will then be moved to the position shown in solid lines in FIG. 20.

A shaft 284 is journalled in the base plate 256 and the top plate 258 and extends longitudinally therebetween. A plurality of rollers 286, preferably in the form of hard rubber rollers, are mounted at spaced locations on the shaft 284. As shown in FIG. 1 of the drawings, the blanks are transferred through the transfer mechanism after pick-off along a "chute line M". The rollers 286 are disposed on one side of the chute line M and are tangetial thereto. Another shaft 288 is journalled in the base plate 256 and top plate 258 and extends therebetween. The shaft 288 is rotatably driven by suitable drive means synchronized with respect to the drive mechanism for driving the first conveyor 16. A series of discs 290 are mounted on the shaft 288 for rotation therewith. The discs 290 are disposed on the opposite side of the chute line M from the rollers 286 and are aligned with the rollers 286. The discs 290 have a peripheral clamping surface 292 disposed in a radius tangential to the radius of the rollers 286. A second portion 298 of the disc 290 is recessed with respect to the clamping surface 292 so as to be spaced a substantial distance from the rollers 286 during rotation of the disc 290. In use, the pick-off mechanism 252 removes a blank 120 from the dispenser carton and locates the blank in a position in which it is engaged between the clamping surface 292 of the disc 290 and the surfaces of the rollers 286.

The principal lateral movement of the carton blank is effected by two sets of conveyor belts 300 which are disposed one set on either side of the chute line M. Each of the drive belt assemblies consists of a central beam 302 (FIG. 19) which extends between face plates 304, which are located at the discharge end of the transfer mechanism, and face plates 307, which are located at the input end of the transfer mechanism. The plates 304 are supported by brackets 306 on posts 308 which extend between the base plate 256 and the top plate 258. The plates 304 and 306 are slotted at 310 so as to be longitudinally adjustable with respect to the transverse bar 302. A locking bolt 312 serves to releasably lock the base plates 304 and 306 with respect to the transverse beam 302. Shafts 314 are journalled in and extend between the base plate 256 and the top plate 258 and extend through the face plates 307. A sprocket 316 is secured for rotation with the shafts 314 between each set of face plates 307. A sprocket 318 is mounted for rotation at the outer end of the face plates 304 and twist belts 300 extend continuously between each of the sprockets 316 and 318. The belts 300 have longitudinal extents disposed in close fitting opposite relationship on opposite sides of the chute line M (FIG. 21). A plastic anti-friction member 320 which has a resilient rubber backing 322 is disposed between the beam member 302 and the longitudinal extent of the belts 300 to provide a backing for supporting the belt over its longitudinal extent along the feed line M.

Tensioning pulleys 324 are slidably mounted on the face plates 306 and the belt 300 is fed around the tensioning pulleys to retain the required tension in the belt in use. As indicated in FIG. 17 of the drawings, the posts 308 are longitudinally adjustable with respect to the base plate 256 and the top plate 258 by means of elongated slots 326.

In addition to the lateral transmission function the transfer mechanism of the present invention serves to (ore-fold) the carton blanks to a generally U-shaped configuration. Pre-folding is achieved by means of plow bars, generally identified by the reference numeral 330 in FIG. 17 of the drawings. Plow bars 330 are supported at one end by means of brackets 332 carried by the shaft 308 which is disposed on the downstream side of the chute line M. The plow bars 330 have a first portion 332 which is disposed on the downstream side of the chute line M (FIG. 20). The plow bars 330 have a second portion 334 which extend obliquely across the chute line M to a position spaced a substantial distance upstream from the chute line M. In travelling across the chute line M in the upstream direction, the second portions 330 of the plow bars also converge. Each of the plow bars 330 has a fin-shaped plate 336 at the outer end thereof which projects in a direction downstream of the direction of travel of the first conveyor. A plate 338 is mounted on the outermost face plates 304 and project outwardly therefrom in a spaced parallel relationship with respect to the fin-shaped plates 336 to permit a carton blank to pass therebetween.

In use, a carton blank is removed from the carton dispenser magazine by the stripper mechanism and located at the nip of the rollers 286 and the discs 290. As previously indicated, the discs 290 are synchronized with respect to the movement of the first pair. The blank 120 is engaged by the roller 286 and the driven disc 290 and transmitted to the nip formed between the belts 300. The belts 300 of each set are spaced one above the other a distance such that they engage the back side panel 126 of the blank 120 closely adjacent the fold lines along which the panel 124 is connected to the adjacent panels 126 and 122 respectively. As the blank is moved along the path of the chute line M by the belts 300, it is engaged by the plow bars 330. The blank 120 is initially in the straight vertical configuration illustrated in FIG. 22 of the drawings. As the blank continues along the chute line M to the point where the plow bars 330 extend across the chute line M, it is progressively folded by the plow bars 330 from the position shown in FIG. 22 to the position shown in FIG. 23 to the position shown in FIG. 24. It will be seen that in all of the transverse movement of the blank during the folding operation, the panel 124 is maintained in the plane of the chute line M. The problems associated with wind resistance in attempting to move a carton blank in the dispenser mechanism are substantially eliminated by reason of the fact that the folding action takes place as the blank moves progressively across the transfer station and the folding is positively effected by means of stationary plow bars.

The transfer mechanism and its associated dispenser mechanism capable of operating at high speed and the partially folded carton blank is shot from the end of the transfer mechanism into the wrapping path to the position shown in FIG. 11 of the drawings. It will be noted that side flap closure rollers 350 and 352 are disposed above and below the partially folded blank 240 and serves to maintain the blank in this position to receive the mandrel 58. The top flap closure roller 350 has a blade member 354 projecting radially outwardly therefrom which engages the end panel 128 as the mandrel moves along the wrapping path and folds the panel 128 inwardly. The bottom roller 352 has a similar blade 356 projecting radially outward therefrom which folds the side wall tab 129 inwardly about the mandrel 58 in advance of the side wall 128. The adhesive which is applied to the tab 129 as it moves laterally through the transfer mechanism serves to secure the tab 129 with respect to the end wall 128. In order to maintain the end wall 128 in engagement with the tab 129 for a period of time sufficient to permit the adhesive to be permanently set, a plurality of pressure arms 358 are mounted at spaced intervals on the drive chain 360 which serves to rotatably drive the roller 352. The pressure pads 358 move longitudinally in the wrapping path at a speed which is synchronized with the speed of movement of the mandrels along the wrapping path. In order to prevent movement of the carton blank with respect to the mandrel during the folding of the end flaps, rubber wiper blades 362 are mounted above and below the mandrel and secured with respect to the frame of the wrapping machine.

Method of Operation

In the operation of the carton wrapping machine of the present invention, the first conveyor 16 and its associated folding rollers 352 and 350 are driven continuously. In addition, the second conveyor 18 is continuously driven at a speed which is synchronized with respect to the speed of the first conveyor. Similarly, the transfer conveyor belts 130 are continuously driven as is the walking beam mechanism of the dispenser magazine. In addition, the pick-off mechanism of the transfer mechanism is synchronized to operate in conjunction with the transverse movement of the first conveyor as are the feeding rollers 286 and 290 which feed the carton blank to the transfer belts 130.

As the mandrels 58 move through the carton loading station, the articles 12 which are to be wrapped within the carton are deposited in the open end of the mandrel. Detector means in the form of an electric eye may be provided downstream of the compartment loading mechanism to detect the presence or absence of the article 12. As the mandrels move towards the wrapping station B, the plungers 58 are advanced by the first guide rails 92 to ensure that the article 12 is located closely adjacent the first datum plane 76 for wrapping.

Simultaneously, the carton blank has been withdrawn from the dispenser mechanism and is fed laterally along the chute line M through the transfer and folding station E to be deposited between the rollers 350 and 352 in a partially folded configuration which opens in the direction opposite to the direction of travel fo the mandrels. The downstream side wall of the mandrel engages the side wall panel 124 of the blank and the blank is folded about the mandrel as it advances between the rollers 352 and 354. The open side of the blank is closed and held in a closed position by the operation of the rollers 352 and 354 and the fingers 358 which are carried by the conveyor chains 360. The finger 358 maintains the side wall in the closed configuration until the adhesive previously applied to the tab 129 has set to a sufficient extent to maintain the package in a sleeve-shaped configuration. As the partially formed carton moves through the wrapping station, the first end which is to be closed is located in the datum plane 76 and a rotary end closure blade 500 and associated plow blades 502, 504 and an adhesive applicator 506 (FIG. 1) are disposed in the datum plane 76 to close the first end of the carton. After the end of the carton has been closed, it is discharged from the first conveyor into the compartments of the second conveyor by the lateral movement of the plungers 58 with respect to the mandrel 16. The second end of the carton is then disposed in the second datum plane 80. Again, the second end of the carton is closed by means of conventional rotary closure blade means and plow bar means and adhesive applicator means as the carton is transported along the second datum plane by means of the second conveyor 18.

Summary

From the foregoing description of the apparatus of the present invention, it will be apparent that a substantial number of advantages are derived from the structure of the apparatus which combine with one another to provide a wrap-around carton forming and loading machine which is relatively simple in construction and which is capable of operating at extremely high speed.

The simplicity in construction is obtained, at least in part, by the simplicity of the structure of the first conveyor mechanism and the structure of the mandrels and pusher units used for forming and transferring the loaded carton to the second conveyor. The structure of the transfer mechanism lends to the capacity of the apparatus to run at a high speed. By reason of the lateral movement of the carton blanks and the simultaneous pre-folding of the carton blanks, the blanks are not subjected to wind resistance which is capable of adversely affecting the speed of operation of the transfer mechanism.

Simplicity of construction is also to be found in the structure of the carton dispenser magazine.

The operating costs of the apparatus of the present invention are maintained at a minimum by reason of the simplicity of the structure of the dispenser magazine, the facility with which the mandrels may be removed and replaced by a different set of mandrels, and the simple manner in which the apparatus may be adjusted to accommodate carton blanks of different lengths.

These and other advantages of the present invention will be apparent to those skilled in the art.

What I claim as my invention is:

1. In a wrap-around forming machine for forming cartons from carton blanks of the type having main body portions of different length and end closure flaps projecting from first and second edges of the main body portion, the improvement of a. first longitudinally elongated conveyor means having a longitudinally elongated first end flap closure station extending in a first datum plane at a first longitudinal edge thereof, said first longitudinally elongated conveyor means being continuously driven through said first end flap closure station, b. a second longitudinally elongated conveyor means having a longitudinally elongated second end flap closure station at a longitudinal edge thereof in a second datum plane which is disposed paralell to and laterally spaced from said first datum plane, said second longitudinally elongated conveyor being continuously driven through said second end flap closure station, c. said first conveyor means having carton forming mandrels extending inwardly from said first datum plane on the side thereof remote from said second datum plane to receive carton blanks of various lengths with said first end edges of said main body portion thereof disposed in said first datum plane, d. said second conveyor means having a longitudinally elongated upwardly directed support surface extending in an edge-to-edge spaced parallel relationship to said first longitudinally elongated conveyor means and disposed inwardly from said second datum plane on the side thereof remote from said first datum plane for receiving the carton blanks after closure of the first end thereof from said first conveyor and locating said second end edges of said main body portion in said second datum plane, e. first end closure means in said first end flap closure station and operating in said first datum plane for closing said first end of said cartons as they are moved through said first end closure station by means of said first conveyor means, f. said second end closure means in said second end flap closure station and operative in said second datum plane for closing said second ends of said cartons as they are moved through said second end closure station by means of said second conveyor means, g. means for moving said partially closed cartons laterally from said first conveyor means to said second conveyor means, and h. a longitudinally elongated rail having a length which is greater than twice the width of the cartons to be formed in the machine, said longitudinally elongated stop rail being disposed above said second conveyor means and extending longitudinally thereof parallel to said second datum plane, said stop rail being located inwardly from said second datum plane for engaging the first closed end of the carton as it is transferred onto said second conveyor means, and restraining the carton against lateral movement away from the second datum plane as the carton is driven continuously through the second end closure station, i. support means supporting said guide rail for movement towards and away from said second datum plane whereby the second end edge of main body portions of different lengths may be located in said second datum plane as said second conveyor moves said cartons through said second end closure station.

* * * * *